US011125449B2

(12) United States Patent
Blanton et al.

(10) Patent No.: US 11,125,449 B2
(45) Date of Patent: Sep. 21, 2021

(54) SYSTEMS AND METHODS FOR TRANSITIONING BETWEEN A COOLING OPERATING MODE AND A REHEAT OPERATING MODE

(71) Applicant: Johnson Controls Technology Company, Auburn Hills, MI (US)

(72) Inventors: Norman J. Blanton, Norman, OK (US); Stephen C. Wilson, Oklahoma City, OK (US); Paul S. Willmus, Norman, OK (US); Bradford G. Briley, Norman, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 32 days.

(21) Appl. No.: 16/370,208

(22) Filed: Mar. 29, 2019

(65) Prior Publication Data

US 2020/0300484 A1 Sep. 24, 2020

Related U.S. Application Data

(60) Provisional application No. 62/821,291, filed on Mar. 20, 2019.

(51) Int. Cl.
*F24F 3/153* (2006.01)
*F24F 11/00* (2018.01)

(52) U.S. Cl.
CPC ..... *F24F 3/153* (2013.01); *F24F 11/0008* (2013.01)

(58) Field of Classification Search
CPC .. F24F 3/153; F24F 11/0008; F24F 2003/144; F25B 2400/01; F25B 2600/0251; F25B 2600/2501; F25B 2600/2507
See application file for complete search history.

(56) References Cited

U.S. PATENT DOCUMENTS 6,705,093 B1 * 3/2004 Taras ..... F24F 3/153 62/238.6
9,239,183 B2 1/2016 Amick
(Continued)

FOREIGN PATENT DOCUMENTS

IN 2038/MUM/2012 1/2014
JP 3342130 B2 11/2002
(Continued)

*Primary Examiner* — Marc E Norman
(74) *Attorney, Agent, or Firm* — Fletcher Yoder, P.C.

(57) ABSTRACT

A heating, ventilation, and/or air conditioning (HVAC) system, includes a cooling circuit, a reheat circuit, and a control system. The cooling circuit includes a condenser, a compressor, an evaporator, and a multi-directional valve, and the HVAC system is configured to circulate refrigerant through the cooling circuit in a cooling operating mode. The reheat circuit includes a reheat heat exchanger, the compressor, the evaporator, and the multi-directional valve, and the HVAC system is configured to circulate refrigerant through the reheat circuit in a reheat operating mode. The control system is configured to execute a switch between the cooling operating mode and the reheat operating mode by sending a signal to the multi-directional valve to adjust from a first position to a second position, interrupting a voltage provided to the compressor at a first time, and restoring application of the voltage to the compressor at a second time that is subsequent to the first time.

22 Claims, 8 Drawing Sheets

(56) References Cited

U.S. PATENT DOCUMENTS

| | | | | |
|---|---|---|---|---|
| 2005/0097909 | A1* | 5/2005 | Cleland | F25D 31/002 62/224 |
| 2012/0272669 | A1* | 11/2012 | Blanton | F24F 11/77 62/89 |

FOREIGN PATENT DOCUMENTS

| | | | | |
|---|---|---|---|---|
| JP | 2006177599 | A | * | 7/2006 |
| KR | 20080001308 | A | | 1/2008 |

* cited by examiner

SYSTEMS AND METHODS FOR TRANSITIONING BETWEEN A COOLING OPERATING MODE AND A REHEAT OPERATING MODE

CROSS REFERENCE TO RELATED APPLICATIONS

This application claims priority from and the benefit of U.S. Provisional Application Ser. No. 62/821,291, entitled "SYSTEMS AND METHODS FOR TRANSITIONING BETWEEN A COOLING OPERATING MODE AND A REHEAT OPERATING MODE," filed Mar. 20, 2019, which is hereby incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a building, home, or other structure. The HVAC system generally includes a vapor compression system having heat exchangers, such as a condenser and an evaporator, which cooperate to transfer thermal energy between the HVAC system and the environment. In some instances, the HVAC system may change operating modes by adjusting the flow path of refrigerant through the vapor compression system. More specifically, refrigerant may be circulated through a first circuit in one operating mode of the HVAC system, and refrigerant may be circulated through a second circuit in another mode of the HVAC system. For example, adjusting refrigerant flow from one circuit to another circuit may transition the HVAC system from operating in a cooling mode to operating in a dehumidification mode. However, changing refrigerant flows between different refrigerant circuits may involve complications due to pressure differences in the various refrigerant circuits, including the components and conduits of the various refrigerant circuits.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system, includes a cooling circuit, a reheat circuit, and a control system. The cooling circuit includes a condenser, a compressor, an evaporator, and a multi-directional valve, and the HVAC system is configured to circulate refrigerant through the cooling circuit in a cooling operating mode. The reheat circuit includes a reheat heat exchanger, the compressor, the evaporator, and the multi-directional valve, and the HVAC system is configured to circulate refrigerant through the reheat circuit in a reheat operating mode. The control system is configured to execute a switch between the cooling operating mode and the reheat operating mode by sending a signal to the multi-directional valve to adjust from a first position to a second position, interrupting a voltage provided to the compressor at a first time, and restoring application of the voltage to the compressor at a second time that is subsequent to the first time.

In another embodiment, a control system for a heating, ventilation, and/or air conditioning (HVAC) system includes a multi-directional valve configured to receive refrigerant from a compressor of the HVAC system and actuate to direct refrigerant through a cooling circuit of the HVAC system in a cooling operating mode and through a reheat circuit of the HVAC system in a reheat operating mode. The control system also includes a controller configured to send a signal to actuate the multi-directional valve to switch between the cooling operating mode and the reheat operating mode, interrupt a voltage provided to the compressor based on the signal, execute a time delay based on the signal, and restore application of the voltage to the compressor after execution of the time delay.

In yet another embodiment, a heating, ventilation, and/or air conditioning (HVAC) system includes a cooling circuit, a reheat circuit, and a control system. The cooling circuit includes a condenser, a compressor, an evaporator, and a multi-directional valve, and the HVAC system is configured to circulate refrigerant through the cooling circuit in a cooling operating mode. The reheat circuit includes a reheat heat exchanger, the compressor, the evaporator, and the multi-directional valve, and the HVAC system is configured to circulate refrigerant through the reheat circuit in a reheat operating mode. The control system is configured to make a determination to transition operation of the HVAC system between the cooling operating mode and the reheat operating mode, send a signal to the multi-directional valve to adjust from a first position to a second position based on the determination, interrupt a voltage provided to the compressor based on the determination, execute a time delay based on the determination, and restore application of the voltage to the compressor at a conclusion of the time delay.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
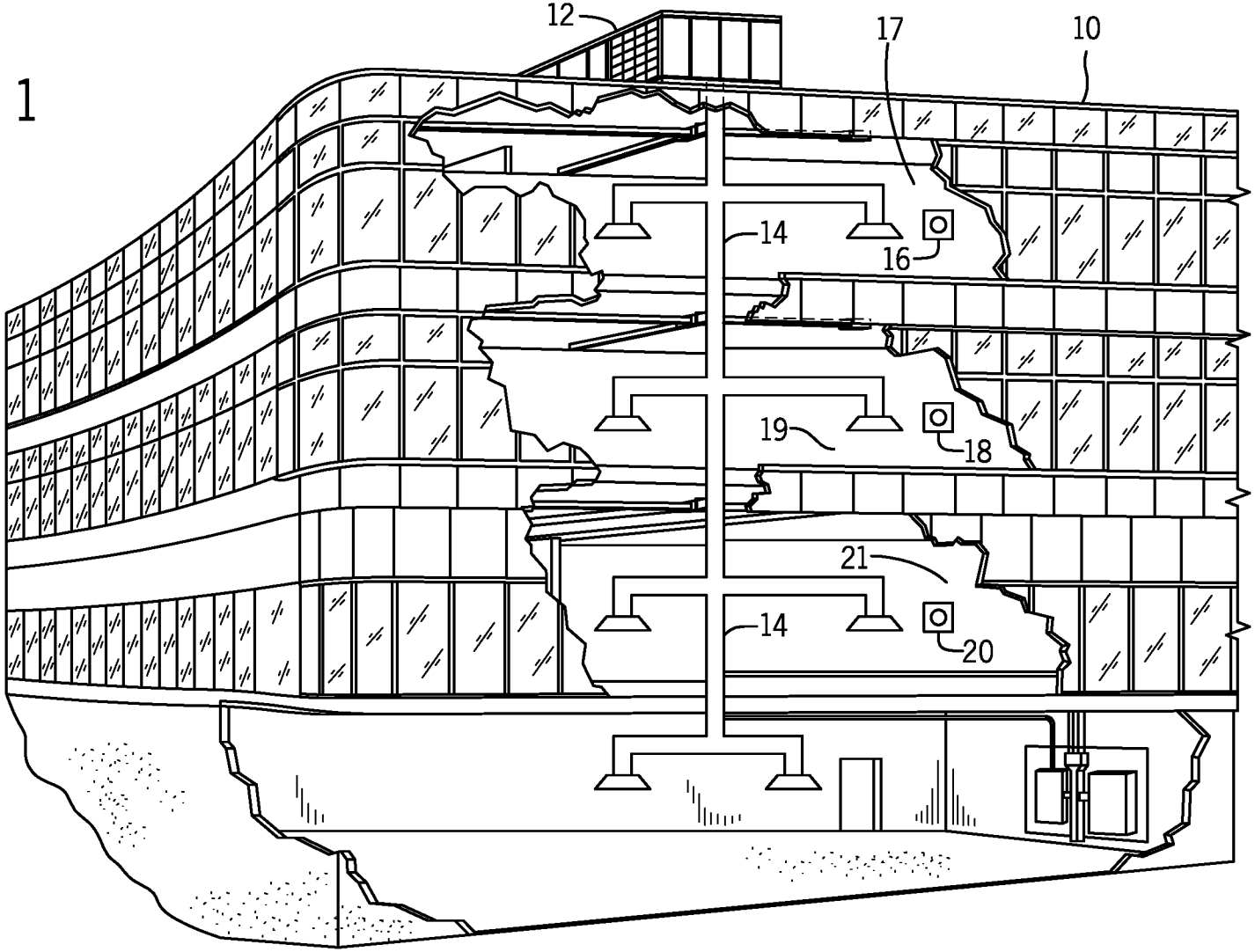
FIG. 1 is a perspective view of an embodiment of a heating, ventilation, and/or air conditioning (HVAC) system for building environmental management that may employ one or more HVAC units, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Generally, a heating, ventilation, and/or air conditioning (HVAC) system may control climate conditions, such as temperature and/or humidity, within a building. The HVAC system may operate in different modes to control the climate conditions within the building, such as controlling temperature and/or humidity of air supplied to the building. For example, the HVAC system may operate in a cooling operating mode, whereby refrigerant is directed through a cooling circuit in order to cool air supplied to the building. In a reheat operating mode, the HVAC system may circulate the refrigerant through a reheat circuit in order to lower the humidity of air supplied to the building. The HVAC system may switch between the cooling operating mode and the reheat operating mode via a multi-directional valve, such as a two-way valve, a three-way valve, or a four-way valve, that switches refrigerant flow between the cooling circuit and the reheat circuit.

In certain embodiments, the HVAC system includes a compressor positioned upstream of the multi-directional valve, where the compressor receives refrigerant from an evaporator, such as a vapor refrigerant, and/or receives refrigerant from recovery circuit(s) of the HVAC system. The compressor may reduce a volume available for the refrigerant and, consequently, increase the pressure and temperature of the refrigerant. The refrigerant may exit the compressor at a discharge side of the compressor and as a high pressure and temperature vapor that flows to the multi-directional valve. After passing through the multi-directional valve, the refrigerant may flow through the cooling circuit or the reheat circuit, depending on a position of the multi-directional valve.

In some instances, during a transition between operating modes of the HVAC system, the multi-directional valve may not completely or fully adjust positionally to transition refrigerant flow between the cooling circuit and the reheat circuit, and/or the position switching of the multi-directional may be delayed due to pressure differences within the circuits, such as a pressure difference between the cooling circuit and the reheat circuit. Such pressure differences may be caused by operation of the compressor positioned upstream of the multi-directional valve. For example, the flow of refrigerant passing from the compressor, through the multi-directional valve, and to the cooling circuit or the reheat circuit may at least partially block the multi-directional valve from fully switching between a cooling circuit position and a reheat circuit position. In a further example, the flow of refrigerant passing from the compressor to the multi-directional valve may create a pressure differential between the cooling circuit and the reheat circuit that at least partially blocks the multi-directional valve from fully changing positions during a transition between operating modes. It is now recognized that temporarily stopping operation of the compressor may improve positional switching of the multi-directional valve. For example, by interrupting and/or delaying a voltage supplied to the compressor, such as a voltage that enables operation of the compressor, pressures within the cooling circuit and/or the reheat circuit may stabilize to improve the positional switching of the multi-directional valve.

Accordingly, the present disclosure provides systems and methods that control operation of a compressor of an HVAC system. As discussed in detail below, the disclosed techniques enable the HVAC system to efficiently and quickly switch between the cooling operating mode and the reheat operating mode. For example, the HVAC system may include a control system that actuates the multi-directional valve to transition from a cooling circuit operation position and a reheat circuit operation position, or vice versa. Thereafter or generally at the same time of actuation of the multi-directional valve, the control system may interrupt a voltage supplied to the compressor to block the compressor from supplying refrigerant to the multi-directional valve and/or to block compression of the refrigerant supplied to the multi-directional valve. After interrupting the voltage, the control system may restore application of the voltage to the compressor at a subsequent time by executing a time delay. The time delay may be any suitable time period between about one second to about ten minutes after the multi-directional valve is actuated and after the voltage supplied to the compressor is interrupted. For example, the time delay may be about two minutes. The time delay may allow refrigerant pressure within the cooling circuit or reheat circuit to stabilize and/or equalize and thus assist in positional transition of the multi-directional valve between the cooling circuit and the reheat circuit. As such, the systems and methods described herein enable efficient and quick transition between the cooling operating mode and the reheat operating mode.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

In any case, the HVAC unit 12 may be an air cooled device that implements a refrigeration cycle to provide conditioned air to the building 10. For example, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the air is conditioned, the HVAC unit 12 may supply the conditioned air to the building 10 via ductwork 14 extending throughout the building 10 from the HVAC unit 12. For example, the ductwork 14 may extend to various individual floors or other sections of the building 10. In some embodiments, the HVAC unit 12 may include a heat pump that provides both heating and cooling to the building 10, for example, with one refrigeration circuit implemented to operate in multiple different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other equipment, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and/or the like. Moreover, the control device 16 may include computer systems that are integrated with or separate from other building control or monitoring systems, and even systems that are remote from the building 10. In some embodiments, the HVAC unit 12 may operate in multiple zones of the building and may be coupled to multiple control devices that each control flow of air in a respective zone. For example, a first control device 16 may control the flow of air in a first zone 17 of the building, a second control device 18 may control the flow of air in a second zone 19 of the building, and a third control device 20 may control the flow of air in a third zone 21 of the building.

Figure 2:
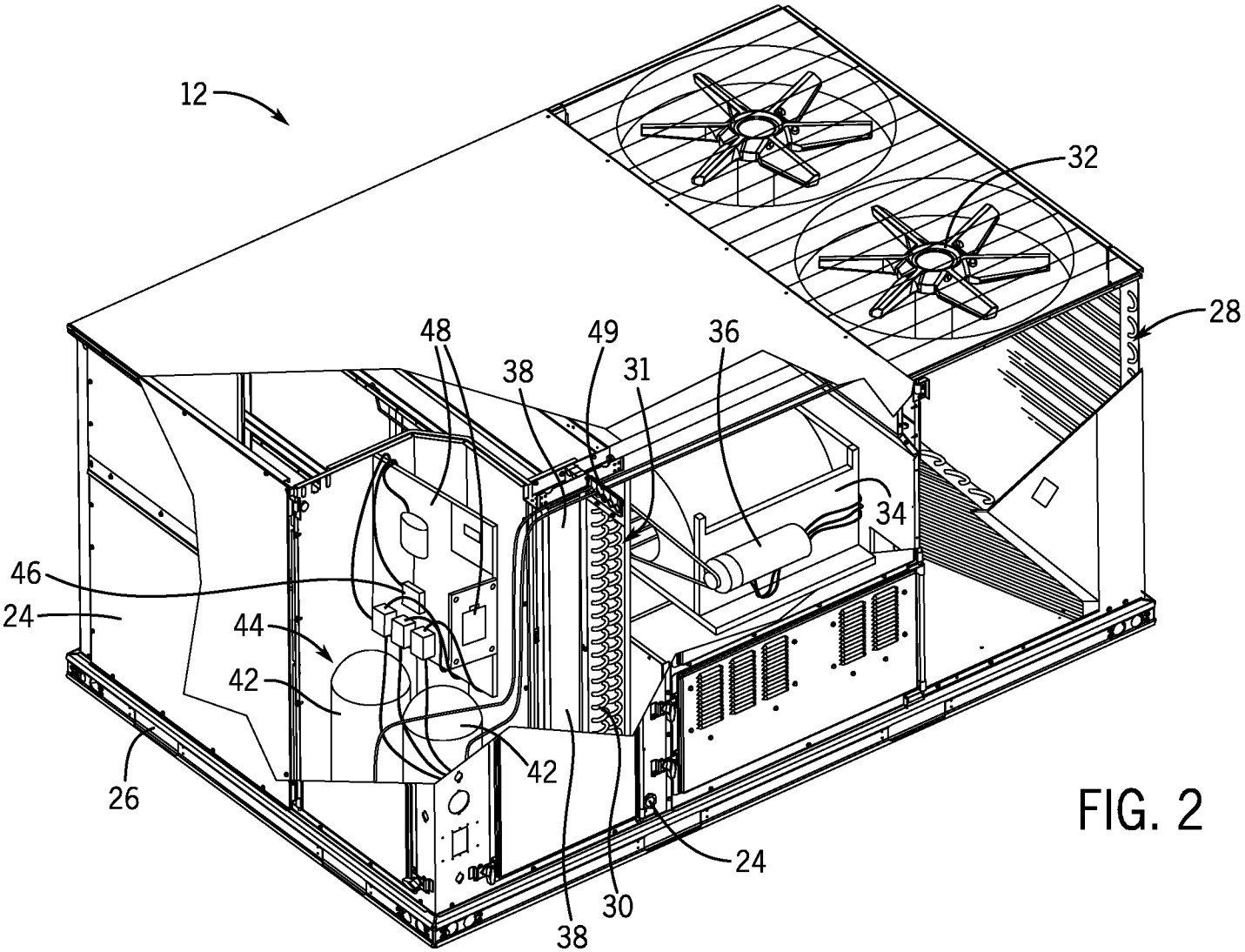
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 or enclosure encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board or controller 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
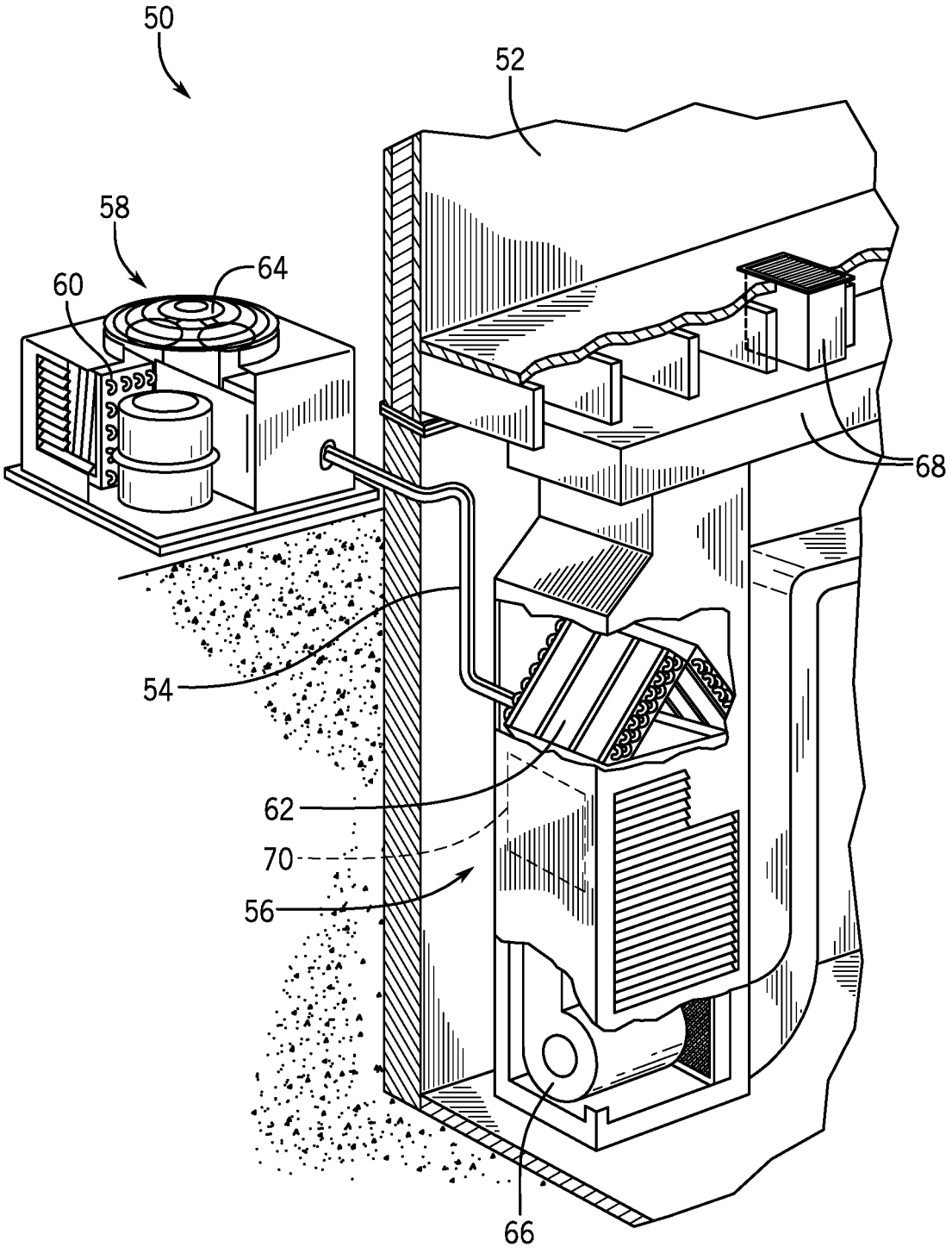
FIG. 3 is a perspective view of an embodiment of a residential, split heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
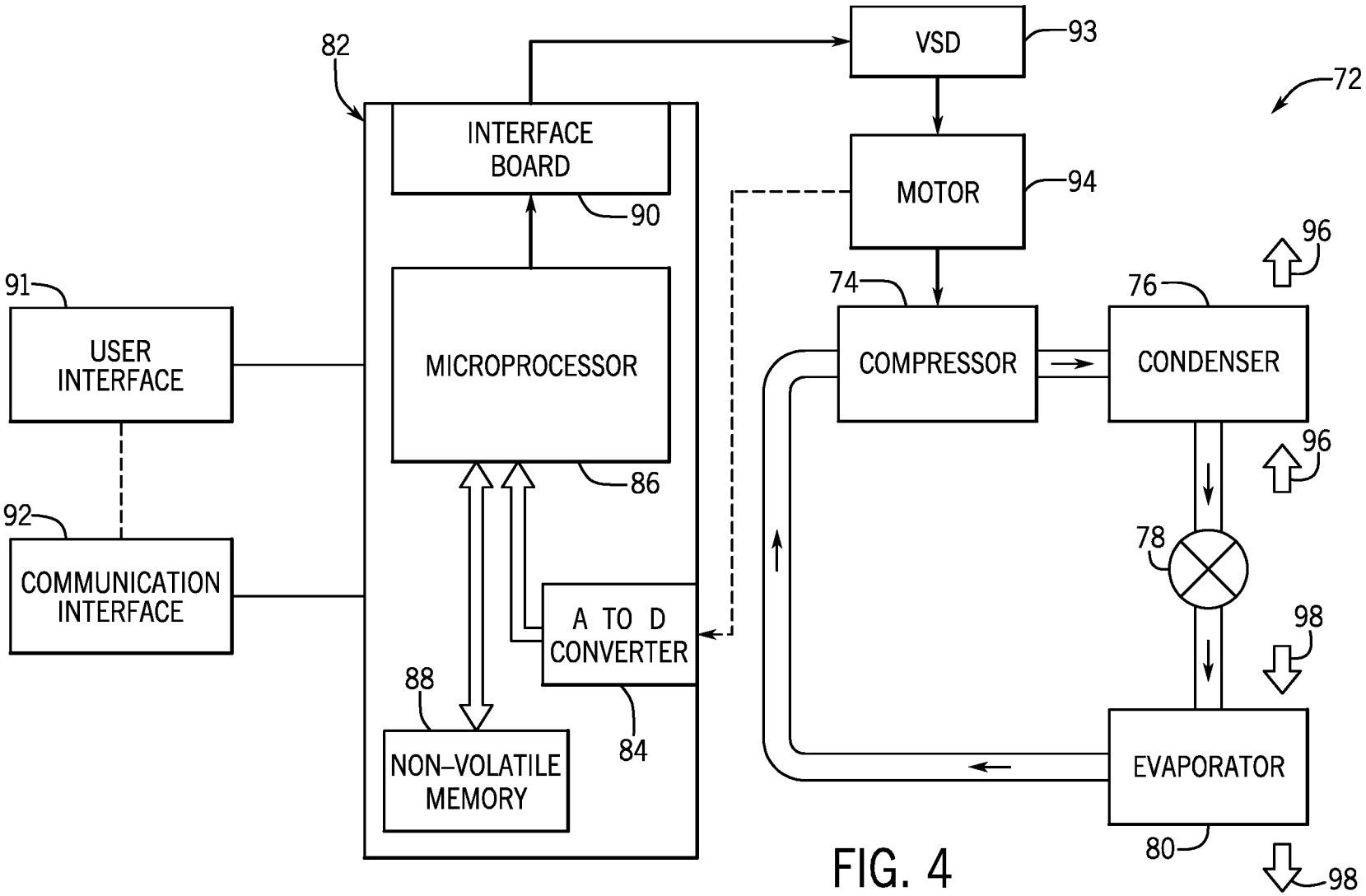
FIG. 4 is a schematic of an embodiment of a vapor compression system that may be used in an HVAC system, in accordance with an aspect of the present disclosure.

FIG. 4 is an embodiment of a vapor compression system 72 that may be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that may be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The description above with reference to FIGS. 1-4 is intended to be illustrative of the context of the present disclosure. The techniques of the present disclosure may be incorporated with any or all of the features described above. In particular, as will be discussed in more detail below, the present disclosure provides techniques that enable an HVAC system to efficiently transition between a cooling operating mode and a reheat operating mode via control of a compressor of the HVAC system. For example, a control system of the HVAC system may interrupt and/or delay application of a voltage to the compressor to enable a multi-directional valve fluidly coupled to the compressor to fully transition between a cooling circuit operating position and a reheat circuit operating position to enable the efficient transition between the cooling operating mode and the reheat operating mode.

Figure 5:
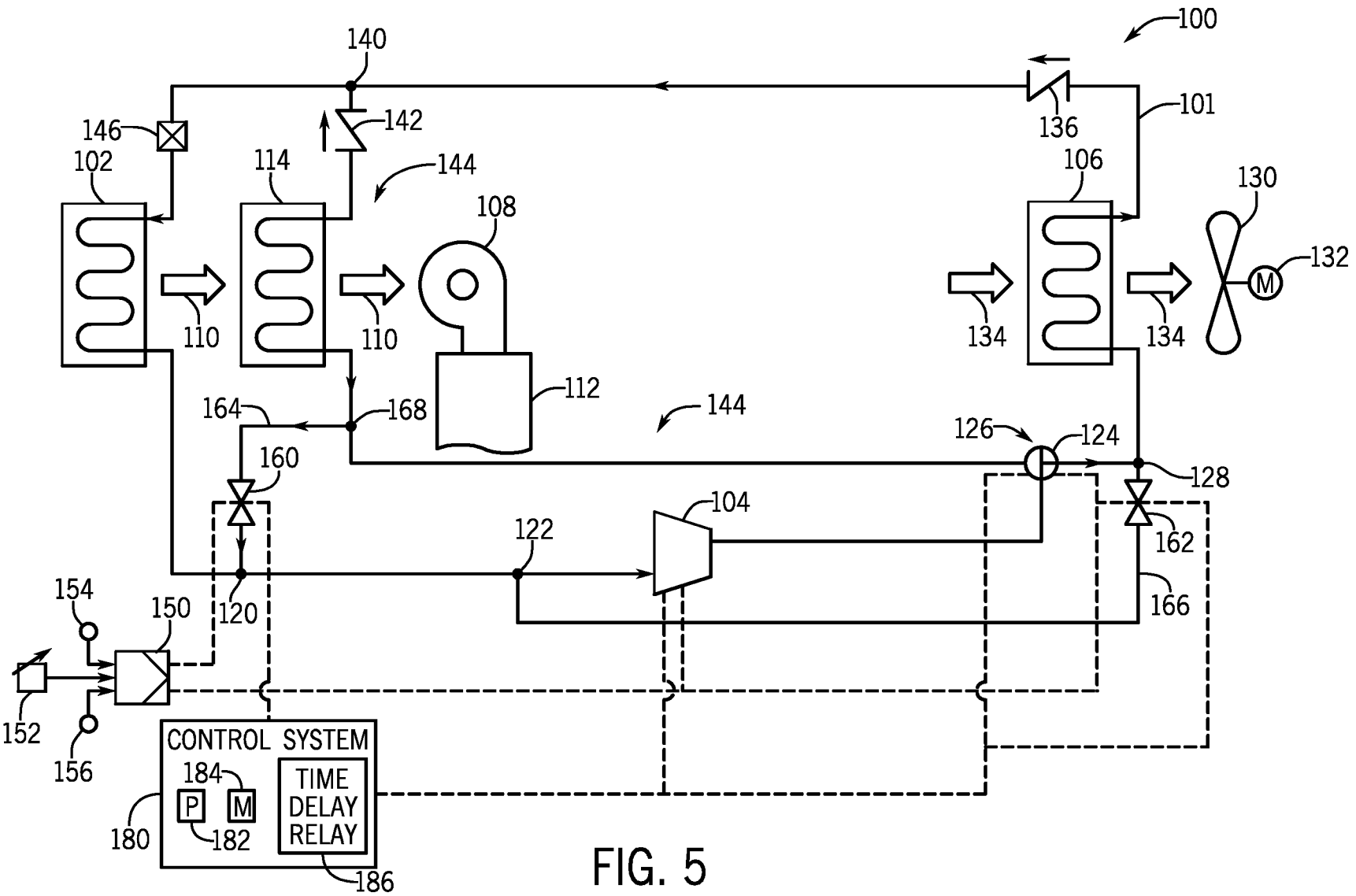
FIG. 5 is a schematic diagram of an embodiment of an HVAC system operating in a cooling operating mode, in accordance with an aspect of the present disclosure.
Figure 6:
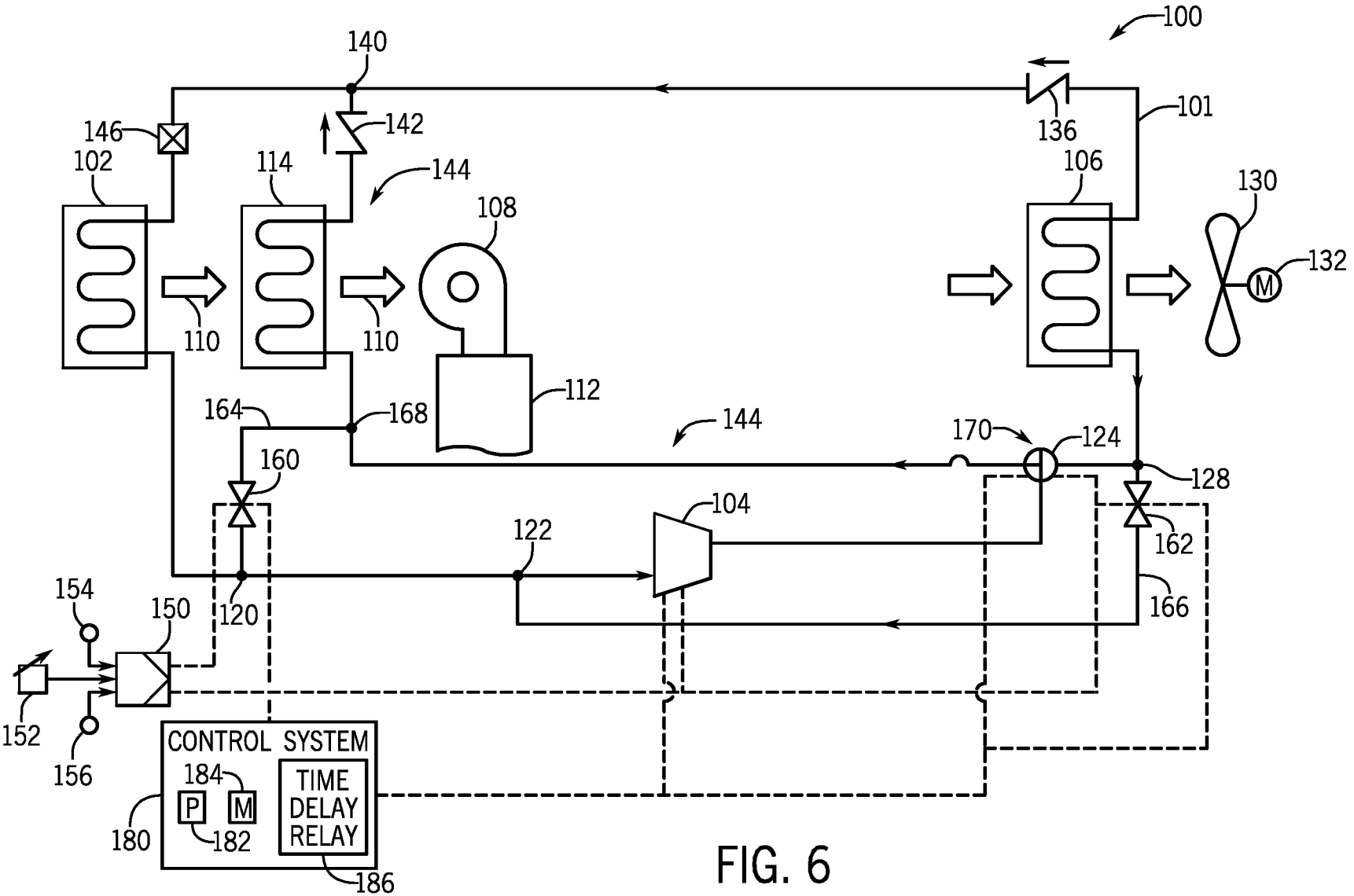
FIG. 6 is a schematic diagram of an embodiment of an HVAC system operating in a reheat operating mode, in accordance with an aspect of the present disclosure.

To help illustrate, FIGS. 5 and 6 are schematic diagrams of embodiments of an HVAC system 100 that may switch between a cooling operating mode and a reheat operating mode. In particular, FIG. 5 illustrates the HVAC system 100 in the cooling operating mode configuration, and FIG. 6 illustrates the HVAC system 100 in the reheat operating mode configuration. The cooling operating mode may be employed to provide cooled air to a conditioned space, while the reheat operating mode may be employed to provide dehumidified air to the conditioned space when additional cooling of the conditioned space is not desired. For example, on days when the ambient temperature is relatively low, and the humidity is relatively high, the reheat operating mode may be employed to provide dehumidified air at a comfortable temperature. It should be noted that the HVAC system 100 may include embodiments or components of the HVAC unit 12 shown in FIG. 1, embodiments or components of the residential heating and cooling system 50 shown in FIG. 3, a rooftop unit (RTU), or any other suitable HVAC system.

As shown in FIG. 5, refrigerant flows through the HVAC system 100 within a cooling circuit 101 during the cooling operating mode. Along the cooling circuit 101, refrigerant flows through an evaporator 102, a compressor 104, and a condenser 106. A blower assembly 108 draws air, generally represented by arrows 110, across the evaporator 102. As the air 110 flows across the evaporator 102, the refrigerant flowing through the evaporator 102 absorbs heat from the air 110 to cool the air 110. The cooled air 110 may then be provided to the conditioned space through ductwork 112. As the air 110 is cooled, moisture also may be removed from the air 110 to dehumidify the air 110. For example, as the air 110 flows across heat exchanger tubes of the evaporator 102, moisture within the air 110 may condense on the tubes as a liquid and may be directed to a drain.

The blower assembly 108 also may draw the air 110 across reheat heat exchanger 114, which is inactive in the cooling operating mode. The reheat heat exchanger 114 is disposed generally downstream of the evaporator 102 with respect to the direction of air 110 flow, and accordingly, the cooled air 110 exiting evaporator 102 may flow across the reheat heat exchanger 114. However, in the cooling operating mode, the reheat heat exchanger 114 contains little or no refrigerant, and accordingly, no substantial heating or cooling occurs as the air 110 flows across reheat heat exchanger 114 in the cooling operating mode.

As the air 110 flows across the evaporator 102, the air 110 transfers heat to the refrigerant flowing within the evaporator 102. As the refrigerant is heated, at least a portion of, or a large portion of, the refrigerant may evaporate into a vapor. The heated refrigerant exiting the evaporator 102 then flows through connection points 120 and 122 disposed along the cooling circuit 101 to enter the suction side of the compressor 104. The compressor 104 reduces the volume available for the refrigerant vapor and, consequently, increases the pressure and temperature of the refrigerant.

The refrigerant exits the discharge side of the compressor 104 as a high pressure and temperature vapor that flows to a multi-directional valve 124. In the cooling operating mode, the multi-directional valve 124 is in a cooling operating mode position 126 and is fluidly coupled to the cooling circuit 101. As such, in the cooling operating mode, the multi-directional valve 124 directs the refrigerant through connection point 128 of the cooling circuit 101 and towards the condenser 106.

One or more fans 130, which are driven by one or more motors 132, draw air 134 across the condenser 106 to cool the refrigerant flowing within the condenser 106. According to certain embodiments, the motor 132 may be controlled by a variable speed drive (VSD) or variable frequency drive (VFD) that may adjust the speed of the motor 132, and thereby adjust the speed of the fans 130. The fans 130 may force or draw air 134 across heat exchanger tubes of the condenser 106. As the air 134 flows across tubes of the condenser 106, heat transfers from the refrigerant vapor within the condenser 106 to the air 134, thereby producing heated air 134 and causing the refrigerant vapor to condense into a liquid. The refrigerant exiting the condenser 106 then flows through a check valve 136 to a connection point 140 along the cooling circuit 101. The check valve 136 may be designed to allow unidirectional flow within the cooling circuit 101 in the direction from the condenser 106 to the connection point 140. In other words, the check valve 136 may impede the flow of refrigerant from the connection point 140 into the condenser 106.

In the cooling operating mode, a check valve 142 inhibits the flow of refrigerant from the connection point 140 into a reheat circuit 144 that may be employed in the reheat operating mode to heat air 110 with the reheat heat exchanger 114. Accordingly, in the cooling operating mode, the refrigerant flows from connection point 140 to an expansion device 146 disposed along the cooling circuit 101, where the refrigerant expands to become a low pressure and temperature liquid. In certain embodiments, some vapor also may be present after expansion in the expansion device 146. The expansion device 146 may be a thermal expansion valve (TXV); however, according to other embodiments, the expansion device 146 may be an electromechanical valve, an orifice, or a capillary tube, among others. Further, in other embodiments, multiple expansion devices 146 may be employed. From the expansion device 146, the refrigerant then enters the evaporator 102, where the low temperature and pressure refrigerant may then again absorb heat from the air 110.

As discussed above, the reheat operating mode may be employed to provide dehumidification when additional cooling is not desired. For example, on days when the ambient temperature is low, but the humidity is high, it may be desirable to provide dehumidified air that is not substantially reduced in temperature to avoid over-cooling the conditioned space. In order to transition from the cooling mode to the reheat mode, the multi-directional valve 124 is switched from the cooling operating mode position 126 shown in FIG. 5 to a reheat operating mode position 170 shown in FIG. 6.

With the multi-directional valve 124 in the reheat operating mode position 170, high-pressure and temperature refrigerant exits the compressor 104 and is directed to the multi-directional valve 124 and the other portions of the reheat circuit 144. Accordingly, in the reheat operating mode, no refrigerant is directed into the condenser 106. The reheat circuit 144 may include the reheat heat exchanger 114, the evaporator 102, and the compressor 104. Within the reheat circuit 144, the refrigerant, which is primarily vapor, flows through a connection point 168 of the reheat circuit 144 and towards the reheat heat exchanger 114. As the refrigerant flows through the reheat heat exchanger 114, the refrigerant transfers heat to the air 110 exiting the evaporator 102. In other words, the high temperature refrigerant flowing through the reheat heat exchanger 114 heats the air 110 exiting the evaporator 102. Accordingly, in the reheat operating mode, the air 110 is first cooled and dehumidified as the air 110 flows across the evaporator 102. The cooled air 110 is then reheated as the air 110 flows across the reheat heat exchanger 114. Thereafter, the dehumidified air may be provided to the conditioned space through the ductwork 112.

As the refrigerant flows through the reheat heat exchanger 114, the refrigerant transfers heat to the air 110, and the refrigerant is condensed. According to certain embodiments, the refrigerant exiting the reheat heat exchanger 114 may be condensed and/or subcooled. The refrigerant then flows through the check valve 142 to the connection point 140. From the connection point 140, the refrigerant is then directed through the expansion device 146 and the evaporator 102. From the evaporator 102, the refrigerant returns to the compressor 104 where the process may begin again.

Operation of the HVAC system 100 may be governed by control system 150 having one or more controllers configured to execute the operational sequences described herein. The control system 150 may transmit control signals to the compressor 104, such as to a motor that drives the compressor 104, and to the multi-directional valve 124 to regulate operation of the HVAC system 100. Although not illustrated, the control system 150 also may be electrically coupled to the blower assembly 108 and/or the motor 132. The control system 150 may receive input from a thermostat 152, and/or sensors 154 and 156, and may use information received from these devices to determine when to switch the HVAC system 100 between the cooling operating mode and the reheat operating mode. Further, in other embodiments, the control system 150 may receive inputs from local or remote command devices, computer systems and processors, and mechanical, electrical, and electromechanical devices that manually or automatically set a temperature and/or humidity-related set point for the HVAC system 100.

The sensors 154 and 156 may detect the temperature and the humidity, respectively, within the conditioned space and may provide data and/or control signals indicative of the temperature and humidity to the control system 150. The control system 150 may then compare the temperature and/or humidity data received from the sensors 154 and 156 to a set point received from the thermostat 152. For example, the control system 150 may determine whether the sensed temperature is higher than a temperature set point. If the sensed temperature is higher than the set point, the control system 150 may place the HVAC system 100 in the cooling operating mode. In particular, the control system 150 may enable operation of the compressor 104 and may actuate the multi-directional valve 124 to be in the cooling operating mode position 126. For example, as described in greater detail below, the control system 150 may interrupt and/or delay operation of the compressor 104, such as by interrupting and/or delaying a voltage applied to the compressor 104, while the multi-directional valve 124 switches between the cooling circuit 101 and the reheat circuit 144. In certain embodiments, the control system 150 also may adjust operation of the blower assembly 108 and the motor 132. In another example, if the sensed temperature is below the temperature set point, the control system 150 may then determine whether the sensed humidity is higher than a humidity set point. If the sensed humidity is higher than the humidity set point, and the conditioned space does not call for cooling, the control system 150 may place the HVAC system 100 in the reheat operating mode, as described further below with respect to FIG. 6.

The control system 150 may execute hardware or software control algorithms to govern operation of the HVAC system 100. According to certain embodiments, the control system 150 may include an analog to digital (A/D) converter, a microprocessor, a non-volatile memory, and one or more interface boards. For example, in certain embodiments, the control system 150 may include a primary controller that receives control signals and/or data from the thermostat 152 and the temperature sensor 154. The primary controller may be employed to govern operation of the compressor 104, as well as other system components. The control system 150 also may include a reheat controller that receives data and/or control signals from the humidity sensor 156. According to certain embodiments, the sensor 156 may be a dehumidistat. The reheat controller may be employed to govern the position of the multi-directional valve 124 and also recovery valves 160 and 162, which are discussed in further detail below, as well as other system components. However, in other embodiments, the configuration of the control system 150 may vary. Further, other devices may, of course, be included in the system, such as additional pressure and/or temperature transducers or switches that sense temperatures and pressures of the refrigerant, the heat exchangers, the inlet and outlet air, and so forth.

According to certain embodiments, the control system 150 may employ two different temperature set points to determine when to switch the HVAC system 100 between the reheat operating mode and the cooling operating mode. For example, the control system 150 may use a first temperature set point to determine when to place the HVAC system 100 in the cooling operating mode when the humidity is low, such as below a humidity set point. If the sensed humidity is below the humidity set point, and the sensed temperature is above the first temperature set point, the control system 150 may operate the HVAC system 100 in the cooling operating mode. The control system 150 may use a second temperature set point to determine when to place the HVAC system 100 in the cooling operating mode when the humidity is high, such as above the humidity set point. According to certain embodiments, the second temperature set point may be approximately two to six degrees higher than the first temperature set point. If the sensed humidity is above the humidity set point and the temperature is above the second temperature set point, the control system 150 may place the HVAC system 100 in the cooling operating mode. However, if the sensed humidity is above the humidity set point and the temperature is below the second temperature set point, the control system 150 may operate the HVAC system 100 in the reheat operating mode.

As illustrated, the control system 150 is also electrically coupled to the recovery valves 160 and 162 of refrigerant recovery circuits 164 and 166, respectively. The refrigerant recovery circuits 164 and 166 may be employed to recover refrigerant from the reheat heat exchanger 114 and the condenser 106, respectively, when switching between the cooling operating mode and the reheat operating mode. For example, when switching from the cooling operating mode to the reheat operating mode, the control system 150 may open the recovery valve 162, which is closed during the cooling operating mode, to direct refrigerant from the condenser 106, through the connection point 128 and the recovery valve 162, and to the connection point 122, where the refrigerant may be directed to the suction side of the compressor 104. When switching from the reheat operating mode to the cooling operating mode, the control system 150 may open the recovery valve 160, which is closed in the reheat operating mode, to drain refrigerant from the reheat heat exchanger 114, through a connection point 168 of the reheat circuit 144, and through the recovery valve 160 to the connection point 120, where the refrigerant may be directed to the suction side of the compressor 104. Both recovery circuits 164 and 166 are fluidly connected to the suction side of the compressor 104 to draw refrigerant from the refrigerant recovery circuits 164 and 166 and back to the compressor 104.

According to certain embodiments, the refrigerant recovery circuits 164 and 166 are designed to allow refrigerant from the inactive reheat heat exchanger 114 or the inactive condenser 106 to return to the compressor 104. The return of refrigerant to the suction side of the compressor 104 may ensure that most, or all, of the refrigerant is circulated through the compressor 104 in both the cooling operating mode and the reheat operating mode. Accordingly, in the cooling operating mode shown in FIG. 5, where the multi-directional valve 124 is in cooling operating mode position 126, the recovery valve 160 may be open, while the recovery valve 162 is closed. In the reheat operating mode shown in FIG. 6, where the multi-directional valve 124 is in a reheat operating mode position 170, the recovery valve 162 may be open, while the recovery valve 160 is closed.

The control system 150 may cycle the recovery valve 160 or 162 on and off or may leave the recovery valve 160 or 162 open to allow refrigerant from the inactive reheat heat exchanger 114 or the inactive condenser 106 to return to the compressor 104. For example, in certain embodiments, the control system 150 may close the recovery valve 160 or 162 after a set amount of time. However, in other embodiments, the control system 150 may leave the recovery valve 160 or 162 open until switching to the other mode of operation. For example, in these embodiments, the control system 150 may close the recovery valve 160 when switching to the reheat operating mode and may close the recovery valve 162 when switching to the cooling operating mode.

Additionally or alternatively, the HVAC system 100 may include a control system 180 configured to control operation of the compressor 104, the multi-directional valve 124, the recovery valve 160, the recovery valve 162, or a combination thereof. As illustrated, the control system 180 includes a processor 182, a memory 184, and a time delay relay 186. The control system 180 may, via a signal sent from the processor 182, actuate the multi-directional valve 124 to switch between positions enabling operation of the cooling circuit 101 and the reheat circuit 144 to enable the HVAC system 100 to operate in the cooling operating mode and the reheat operating mode, respectively. The control system 180 may also open the recovery valve 160 to enable recovery of the refrigerant from the reheat circuit 144 while the HVAC system 100 is operating in the cooling operating mode, and may open the recovery valve 162 to enable recovery of the refrigerant from the cooling circuit 101 while the HVAC system 100 is operating in the reheat operating mode.

In certain embodiments, the control system 180 may control the compressor 104, the multi-directional valve 124, the recovery valve 160, the recovery valve 162, or the combination thereof, by executing a time delay via the time delay relay 186. For example, to facilitate transition of the HVAC system 100 from the cooling operating mode to the reheat operating mode, the control system 180 may send a signal to the multi-directional valve 124 to transition from the cooling operating mode position 126 of FIG. 5 to the reheat operating mode position 170 of FIG. 6 at a first time. The control system 180 may also send a signal to the recovery valve 160 and/or the recovery valve 162 to open or close. For example, to facilitate transition of the HVAC system 100 from the cooling operating mode to the reheat operating mode, if the recovery valve 160 is not already closed, the control system 180 may output a signal to the recovery valve 160 to close and block refrigerant flow along the recovery circuit 164, such as by interrupting or applying a voltage to the recovery valve 160. Additionally, the control system 180 may output a signal to the recovery valve 162 to open to enable refrigerant to flow from the cooling circuit 101 and along the recovery circuit 166. In certain embodiments, the refrigerant flow from the cooling circuit 101 may cause the pressure within the cooling circuit 101 to drop, stabilize, and/or equalize relative to the pressure within the reheat circuit 144.

At substantially the same time or shortly after sending the signal(s) to the multi-directional valve 124, the recovery valve 160, and/or the recovery valve 162, the control system 180 may interrupt and/or stop the application of voltage to the compressor 104, such as a voltage of twenty-four volts or another suitable voltage that enables operation of the compressor 104. The removal of voltage applied to the compressor 104 may block the compressor 104 from continuing to supply compressed refrigerant to the multi-directional valve 124 and/or may cause the pressure within the cooling circuit 101 to decrease. As such, the pressure within the cooling circuit 101 and the pressure within the reheat circuit 144 may generally stabilize and/or equalize. The stabilization of the pressure within the cooling circuit 101 may facilitate or may assist transition of the multi-directional valve 124 from being fluidly coupled with the cooling circuit 101 to being fluidly coupled with the reheat circuit 144. For example, the multi-directional valve 124 may be a snap-acting valve that more easily or readily switches from the cooling circuit 101 to the reheat circuit 144 after the stabilization of pressure.

After interrupting the voltage provided to the compressor 104, the control system 180 may execute the time delay, via the time delay relay 186, prior to restoring application of the voltage to the compressor 104. The time delay may facilitate or assist actuation of the multi-directional valve 124, because the pressure of the refrigerant within the condenser 106 and within the cooling circuit 101 may generally stabilize and/or drop during suspension of compressor 104 operation. The time delay may be any time period between about one second and thirty minutes, twenty seconds and ten minutes, twenty seconds and five minutes, one minute and three minutes, one and a half minutes and two and a half minutes, one minute and fifty seconds and two minutes and ten seconds, or any other suitable time delay. In some embodiments, a value of the time delay may be received via user input and/or may be determined or calculated by the control system 180 based on user input(s), a time associated with a control signal sent to the multi-directional valve 124, a type and/or size of the compressor 104, a type and/or size of the multi-directional valve 124, a type of refrigerant, relative sizes/lengths of the cooling circuit 101 and the reheat circuit 144, a sensed pressure of the cooling circuit 101, a sensed pressure of the reheat circuit 144, other operating conditions of the HVAC system 100, or a combination thereof. After expiration of the time delay, such as at a second time that is subsequent to the first time, the control system 180 may then restore application of the voltage to the compressor 104 to enable the compressor 104 to supply and flow refrigerant, such as compressed refrigerant, to the multi-directional valve 124 and the reheat circuit 144. In this manner, the control system 180 may execute the time delay to facilitate transition of the HVAC system 100 from the cooling operating mode to the reheat operating mode, and more particularly, to improve positional switching of the multi-directional valve 124 during the transition from the cooling operating mode to the reheat operating mode.

In certain embodiments, the control system 180 may include a double pole, double throw ("DPDT") relay configured to energize the compressor. For example, the DPDT relay may include two sets of contacts. A first set of contacts of the DPDT relay may be used to energize the compressor 104 with no delay, and a second set of contacts may be used to delay energization of the compressor 104, such as by delaying application of the voltage to the compressor 104. For example, the second set of contacts may be coupled to the time delay relay 186 such that the time delay relay 186 delays application of the voltage from the second set of contacts of the DPDT relay to the compressor 104. In some embodiments, the first set of contacts of the DPDT relay may be used to energize the compressor 104 in the cooling operating mode with no delay, such as when switching from the reheat operating mode to the cooling operating mode. The second set of contacts of the DPDT relay may be used to energize the compressor 104 in the reheat operating mode with the time delay, such as when switching from the cooling operating mode to the reheat operating mode.

Additionally or alternatively, to facilitate transition of the HVAC system 100 from the reheat operating mode to the cooling operating mode, the control system 180 may send a signal to the multi-directional valve 124 to transition from the reheat operating mode position 170 of FIG. 6 to the cooling operating mode position 126 of FIG. 5. The control system 180 may also send a signal to the recovery valve 160 and/or the recovery valve 162 to open or close. In certain embodiments, the control system 180 may open and/or close the recovery valve 160 and the recovery valve 162 by interrupting and/or applying a voltage to the recovery valve 160 and/or the recovery valve 162. For example, to facilitate transition of the HVAC system 100 from the reheat operating mode to the cooling operating mode, if the recovery valve 162 is not already closed, the control system 180 may output a signal to the recovery valve 162 to close to block refrigerant flow along the recovery circuit 166, such as by interrupting or applying a voltage to the recovery valve 162. Additionally, the control system 180 may output a signal to the recovery valve 160 to open to enable refrigerant to flow from the reheat circuit 144 and along the recovery circuit 166. In certain embodiments, the refrigerant flow from the reheat circuit 144 may cause the pressure within the reheat circuit 144 to drop, stabilize, and/or equalize relative to the pressure within the cooling circuit 101.

At substantially the same time or shortly after sending the signal(s) to the multi-directional valve 124, the recovery valve 160, and/or the recovery valve 162, the control system 180 may interrupt and/or stop the application of voltage to the compressor 104. The removal of voltage applied to the compressor 104 may block the compressor 104 from supplying compressed refrigerant to the multi-directional valve 124 and/or may cause the pressure within the reheat circuit 144 to decrease. As such, the pressure within the reheat circuit 144 and the pressure within the cooling circuit 101 may generally stabilize and/or equalize. The stabilization of the pressure within the reheat circuit 144 may facilitate or may assist transition of the multi-directional valve 124 from being fluidly coupled with the reheat circuit 144 to being fluidly coupled with the cooling circuit 101. For example, the multi-directional valve 124 may be a snap-acting valve that more easily or readily switches from the reheat circuit 144 to the cooling circuit 101 after the stabilization of pressure.

After interrupting the voltage provided to the compressor 104, the control system 180 may execute the time delay, via the time delay relay 186, prior to restoring application of the voltage to the compressor 104. The time delay may facilitate or assist actuation of the multi-directional valve 124, because the pressure of the refrigerant within the reheat heat exchanger 114 and within the reheat circuit 144 may generally stabilize and/or drop. After expiration of the time delay, the control system 180 may then restore application of the voltage to the compressor 104 to enable the compressor 104 to supply and flow refrigerant, such as compressed refrigerant, to the multi-directional valve 124 and the cooling circuit 101. In this manner, the control system 180 may execute the time delay to facilitate transition of the HVAC system 100 from the reheat operating mode to the cooling operating mode, and more particularly, to improve positional switching of the multi-directional valve 124 during the transition from the reheat operating mode to the cooling operating mode.

The control systems described herein, such as the control panel 82 and the control systems 150 and 180 may include processors, such as the processors 86 and 182, and memories, such as the memories 88 and 184. The processors may be used to execute software, such as software stored in the memories for controlling the HVAC system 100. Moreover, the processors may include multiple microprocessors, one or more "general-purpose" microprocessors, one or more special-purpose microprocessors, and/or one or more application specific integrated circuits (ASICS), or some combination thereof. For example, the processors may include one or more reduced instruction set (RISC) or complex instruction set (CISC) processors. Each of the memories may include a volatile memory, such as random access memory (RAM), and/or a nonvolatile memory, such as read-only memory (ROM). The memories may store a variety of information and may be used for various purposes. For example, the memories may store processor-executable instructions, such as firmware or software for controlling the HVAC system 100, for the processors to execute. The storage device(s) may include ROM, flash memory, a hard drive, or any other suitable optical, magnetic, or solid-state storage medium, or a combination thereof. The storage device(s) may store data, instructions, and any other suitable data. The processors and/or the memories may be located in any suitable portion of the system. For example, a memory device for storing instructions, such as software or firmware for controlling portions of the HVAC system 100, may be located in or associated with any of the control systems.

Figure 7:
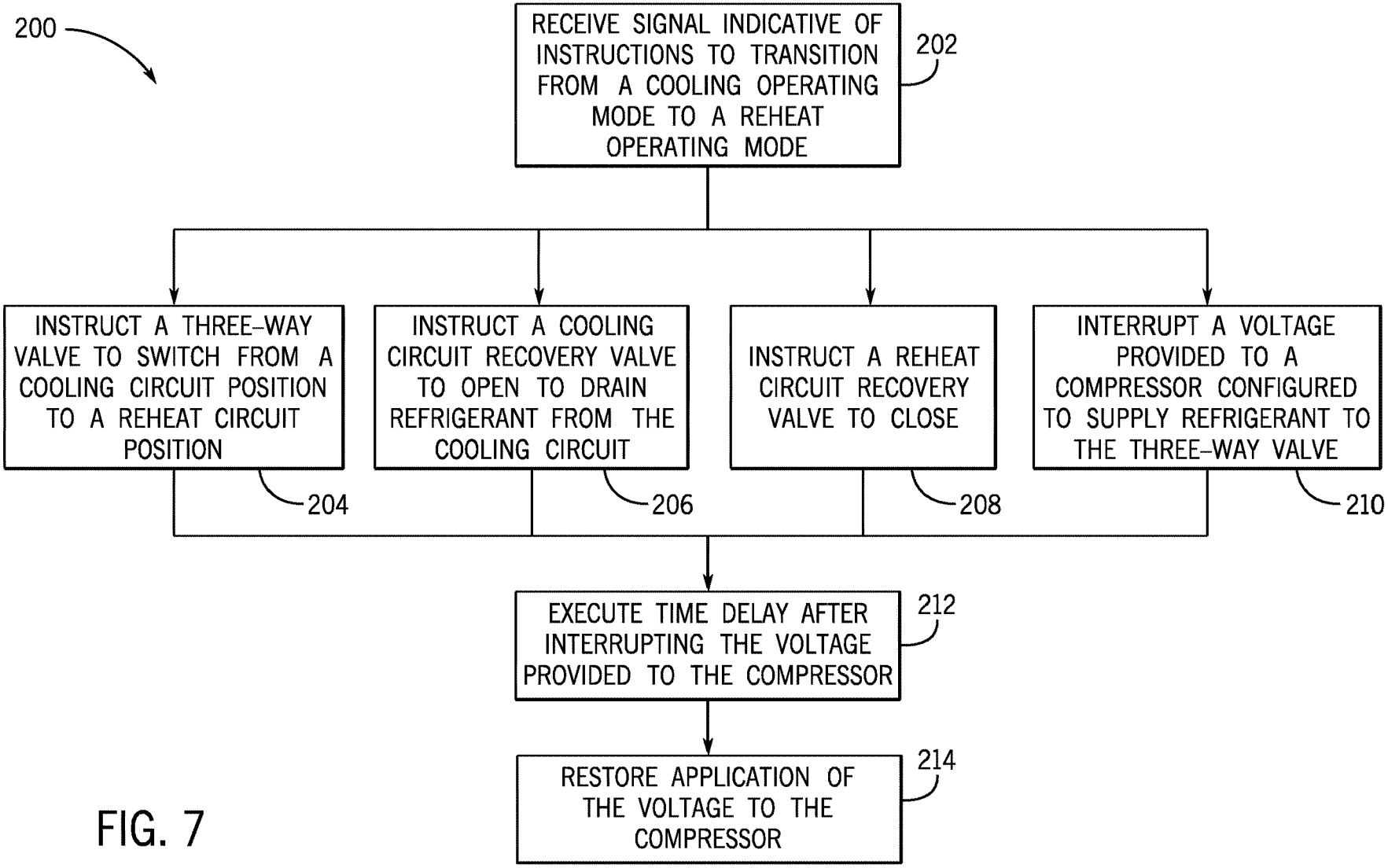
FIG. 7 is a flow diagram of an embodiment of a process for adjusting the position of a multi-directional valve of the HVAC system of FIG. 5 from a cooling operating mode position to a reheat operating mode position, in accordance with an aspect of the present disclosure.

FIG. 7 is a flow diagram of an embodiment of a process 200 for switching the multi-directional valve 124 of the HVAC system 100 of FIG. 5 from the cooling operating mode position 126 to the reheat operating mode position 170. In certain embodiments, the control system 180 of the HVAC system 100 may perform some or all of the steps of the process 200. At block 202, the control system 180 may receive a signal indicative of instructions to transition the HVAC system 100 from the cooling operating mode to the reheat operating mode. The signal may be received from another controller of the HVAC system 100, such as the control system 150. In certain embodiments, block 202 may be omitted. For example, the control system 180 may determine that the HVAC system 100 should transition from the cooling operating mode to the reheat operating mode based on sensed parameters, such as a sensed temperate and/or humidity, operator inputs, and other inputs. In some embodiments, the control system 150 and/or the control system 180 may determine that the HVAC system 100 should transition from the cooling operating mode to the reheat operating mode based on a humidity, such as a sensed humidity, exceeding a set point humidity. For example, the set point humidity may be received and/or determined by the control system 150 and/or the control system 180 based on user input(s), sensed parameters, and other values associated with the HVAC system 100. As such, the control system 150 and/or the control system 180 may make a determination that the HVAC system 100 should transition operation from the cooling operating mode to the reheat operating mode.

At block 204, the control system 180 may instruct the multi-directional valve 124 to switch from the cooling operating mode position 126, or a position enabling operation of the cooling circuit 101, to the reheat operating mode position 170, or a position enabling operation of the reheat circuit 144. For example, the control system 180 may output a signal to the multi-directional valve 124 indicative of instructions to switch from the cooling operating mode position 126 to the reheat operating mode position 170. In response, the multi-directional valve 124 may switch from a position fluidly coupled with the cooling circuit 101 to a position fluidly coupled with the reheat circuit 144 in order to transition the HVAC system 100 from the cooling operating mode to the reheat operating mode.

At block 206, the control system 180 may instruct the recovery valve 162 to open to enable refrigerant to flow from the cooling circuit 101 and along the recovery circuit 166, such as by outputting a signal to the recovery valve 162, by removing a voltage applied to the recovery valve 162, or by applying a voltage to the recovery valve 162. In certain embodiments, the refrigerant flow from the cooling circuit 101 may cause the pressure within the cooling circuit 101 to drop, stabilize, and/or equalize relative to the pressure within the reheat circuit 144.

At block 208, the control system 180 may instruct the recovery valve 160 to close to block refrigerant flow from the reheat circuit 144 and along the recovery circuit 164, such as by outputting a signal to the recovery valve 160, by removing a voltage applied to the recovery valve 160, or by applying a voltage to the recovery valve 160. In certain embodiments, the recovery valve 160 may already be closed, and block 208 may be omitted.

At block 210, the control system 180 may interrupt a voltage provided to the compressor 104 that is configured to supply refrigerant to the multi-directional valve 124. The interruption of the voltage applied to the compressor 104 may block the compressor 104 from supplying compressed refrigerant to the multi-directional valve 124. In some embodiments, the control system 180 may instruct the recovery valve 162 to open, may instruct the recovery valve 160 to close, may interrupt the voltage provided to the compressor 104, or a combination thereof, based upon a determination that the HVAC system 100 should transition operation from the cooling operating mode to the reheat operating mode.

At block 212, the control system 180 may execute the time delay via the time delay relay 186. For example, execution of the time delay may be triggered or initiated upon the output of the signal to the multi-directional valve 124 to switch positions. As described above, the time delay may be any suitable time period, such as between about twenty seconds and about ten minutes, to enable the multi-directional valve 124 to switch from the cooling circuit 101 operating position to the reheat circuit 144 operating position prior to restart of the compressor 104. During the time delay, the pressure within the cooling circuit 101 may generally decrease. As such, the pressure within the cooling circuit 101 and the pressure within the reheat circuit 144 may generally stabilize and/or equalize. The stabilization of the pressure within the cooling circuit 101 may facilitate or may assist transition of the multi-directional valve 124 from being fluidly coupled with the cooling circuit 101 to being fluidly coupled with the reheat circuit 144. The time delay may be determined via user input(s), a time associated with a control signal sent to the multi-directional valve 124, a type and/or size of the compressor 104, a type and/or size of the multi-directional valve 124, a type of refrigerant, relative sizes/lengths of the cooling circuit 101 and the reheat circuit 144, a sensed pressure of the cooling circuit 101, a sensed pressure of the reheat circuit 144, other operating conditions of the HVAC system 100, or a combination thereof.

After execution of the time delay, the control system 180 may, as indicated by block 214, restore application of the voltage to the compressor 104. The voltage applied to the compressor 104 may enable the compressor 104 to continue supplying the refrigerant to the multi-directional valve 124, such that the multi-directional valve 124 may direct the refrigerant through the reheat circuit 144. As such, the control system 180, via the process 200, enables improved transition from the cooling operating mode to the reheat operating mode, and particularly improved positional transition of the multi-directional valve 124.

Figure 8:
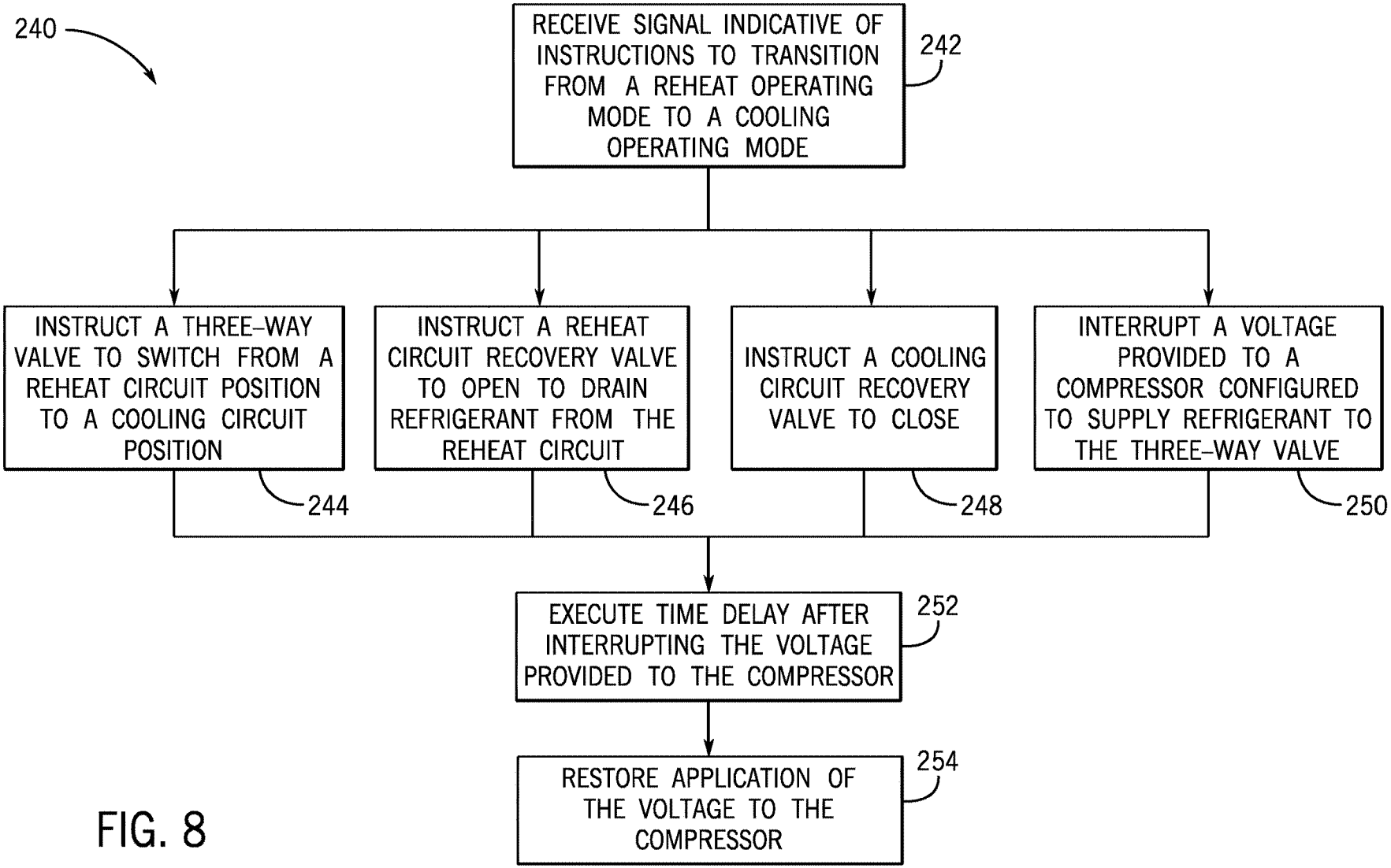
FIG. 8 is a flow diagram of an embodiment of a process for adjusting the position of a multi-directional valve of the HVAC system of FIG. 6 from a reheat operating mode position to a cooling operating mode position, in accordance with an aspect of the present disclosure.

FIG. 8 is a flow diagram of an embodiment of a process 240 for switching the multi-directional valve 124 of the HVAC system 100 of FIG. 6 from the reheat operating mode to the cooling operating mode. In certain embodiments, the control system 180 of the HVAC system 100 may perform some or all of the steps of the process 240. At block 242, the control system 180 may receive a signal indicative of instructions to transition the HVAC system 100 from the reheat operating mode to the cooling operating mode. The signal may be received from another controller of the HVAC system 100, such as the control system 150. In certain embodiments, block 202 may be omitted. For example, the control system 180 may determine that the HVAC system 100 should transition from the reheat operating mode to the cooling operating mode based on sensed parameters, such as a sensed temperate and/or humidity, operator inputs, and other inputs. In some embodiments, the control system 150 and/or the control system 180 may determine that the HVAC system 100 should transition from the reheat operating mode to the cooling operating mode based on a humidity, such as a sensed humidity, being less than or equal to a set point humidity. For example, the set point humidity may be received and/or determined by the control system 150 and/or the control system 180 based on user input(s), sensed parameters, and other values associated with the HVAC system 100. As such, the control system 150 and/or the control system 180 may make a determination that the HVAC system 100 should transition operation from the reheat operating mode to the cooling operating mode.

At block 244, the control system 180 may instruct the multi-directional valve 124 to switch from the reheat operating mode position 170, or a position enabling operation of the reheat circuit 144, to the cooling operating mode position 126, or a position enabling operation of the cooling circuit 101. For example, the control system 180 may output a signal to the multi-directional valve 124 indicative of instructions to switch from the reheat operating mode position 170 to the cooling operating mode position 126. In response, the multi-directional valve 124 may switch from a position fluidly coupled with the reheat circuit 144 to a position fluidly coupled with the cooling circuit 101 in order to transition the HVAC system 100 from the reheat operating mode to the cooling operating mode.

At block 246, the control system 180 may instruct the recovery valve 160 to open to enable refrigerant flow from the reheat circuit 144 and along the recovery circuit 164, such as by outputting a signal to the recovery valve 160, by removing a voltage applied to the recovery valve 160, or by applying a voltage to the recovery valve 160. In certain embodiments, the refrigerant flow from the reheat circuit 144 via the recovery circuit 164 may cause the pressure within the reheat circuit 144 to drop, stabilize, and/or equalize relative to the pressure within the cooling circuit 101.

At block 248, the control system 180 may instruct the recovery valve 162 to close to block refrigerant flow from the cooling circuit 101 and along the recovery circuit 166, such as by outputting a signal to the recovery valve 162, by removing a voltage applied to the recovery valve 162, or by applying a voltage to the recovery valve 162. In certain embodiments, the recovery valve 162 may already be closed, and block 248 may be omitted.

At block 250, the control system 180 may interrupt a voltage provided to the compressor 104 that is configured to supply refrigerant to the multi-directional valve 124. The interruption of the voltage applied to the compressor 104 may block the compressor 104 from supplying compressed refrigerant to the multi-directional valve 124. In some embodiments, the control system 180 may instruct the recovery valve 162 to close, may instruct the recovery valve 160 to open, may interrupt the voltage provided to the compressor 104, or a combination thereof, based upon a determination that the HVAC system 100 should transition operation from the reheat operating mode to the cooling operating mode.

At block 252, the control system 180 may execute the time delay via the time delay relay 186. For example, execution of the time delay may be triggered or initiated upon the output of the signal to the multi-directional valve 124 to switch positions. As described above, the time delay may be any suitable time period, such as between about twenty seconds and about ten minutes, to enable the multi-directional valve 124 to switch from the reheat circuit 144 operating position to the cooling circuit 101 operating position prior to restart of the compressor 104. During the time delay, the pressure within the reheat circuit 144 may generally decrease. As such, the pressure within the reheat circuit 144 and the pressure within the cooling circuit 101 may generally stabilize and/or equalize. The stabilization of the pressure within the reheat circuit 144 may facilitate or may assist transition of the multi-directional valve 124 from being fluidly coupled with the reheat circuit 144 to being fluidly coupled with the cooling circuit 101. The time delay may be determined via user input(s), a time associated with a control signal sent to the multi-directional valve 124, a type and/or size of the compressor 104, a type and/or size of the multi-directional valve 124, a type of refrigerant, relative sizes/lengths of the cooling circuit 101 and the reheat circuit 144, a sensed pressure of the cooling circuit 101, a sensed pressure of the reheat circuit 144, other operating conditions of the HVAC system 100, or a combination thereof.

After execution of the time delay, the control system 180 may, as indicated by block 254, restore application of the voltage to the compressor 104. The voltage applied to the compressor 104 may enable the compressor 104 to continue supplying refrigerant to the multi-directional valve 124, such that the multi-directional valve 124 may direct the refrigerant to the cooling circuit 101. As such, the control system 180, via the process 240, enables improved transition from the reheat operating mode to the cooling operating mode and particularly improved positional transition of the multi-directional valve 124.

Accordingly, the present disclosure provides systems and methods that control operation of a compressor of an HVAC system. The disclosed techniques enable the HVAC system to efficiently and quickly switch between a cooling operating mode and a reheat operating mode. For example, the HVAC system may include a control system that actuates a multi-directional valve to transition from a cooling circuit operation position to a reheat circuit operation position, or vice versa. Thereafter or generally at the same time of actuation of the multi-directional valve, the control system may interrupt a voltage supplied to the compressor to suspend operation of the compressor in order to block the compressor from supplying refrigerant to the multi-directional valve and/or to block compression of the refrigerant supplied to the multi-directional valve. After interrupting the voltage, the control system may execute a time delay prior to restoring application of the voltage to the compressor. The time delay may enable refrigerant pressure within the cooling circuit or reheat circuit to stabilize and/or equalize and thus assist in positional transition of the multi-directional valve between the cooling circuit and the reheat circuit. As such, the systems and methods described herein enable efficient and quick transition between the cooling operating mode and the reheat operating mode.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A heating, ventilation, and/or air conditioning (HVAC) system, comprising:

a cooling circuit including a condenser, a compressor, an evaporator, and a multi-directional valve, wherein the HVAC system is configured to circulate refrigerant through the cooling circuit in a cooling operating mode;

a reheat circuit including a reheat heat exchanger, the compressor, the evaporator, and the multi-directional valve, wherein the HVAC system is configured to circulate refrigerant through the reheat circuit in a reheat operating mode; and a control system configured to execute a switch between the cooling operating mode and the reheat operating mode by sending a signal to the multi-directional valve to adjust from a first position to a second position, interrupting a voltage provided to the compressor while sending the signal to the multidirectional valve, after sending the signal to the multi-directional valve, or both, and restoring application of the voltage to the compressor subsequent to interrupting the voltage.

2. The HVAC system of claim 1, wherein the control system includes a time delay relay configured to execute a time delay and to restore application of the voltage to the compressor after the time delay.

3. The HVAC system of claim 2, wherein the time delay relay is external to a main controller of the control system.

4. The HVAC system of claim 2, wherein the time delay relay is integral to a main controller of the control system.

5. The HVAC system of claim 2, wherein the time delay is between twenty seconds and ten minutes.

6. The HVAC system of claim 1, wherein the control system is configured to interrupt the voltage provided to the compressor based on the signal.

7. The HVAC system of claim 1, wherein the voltage is a first voltage, wherein the HVAC system includes a recovery circuit extending between the condenser and the compressor and including a recovery valve, and wherein the control system is configured to execute the switch by interrupting or providing a second voltage to the recovery valve.

8. The HVAC system of claim 7, comprising an additional recovery circuit extending between the reheat heat exchanger and the compressor and including an additional recovery valve, wherein the control system is configured to execute the switch by interrupting or providing a third voltage to the additional recovery valve.

9. The HVAC system of claim 7, wherein the control system is configured to interrupt or provide the second voltage to open the recovery valve to direct refrigerant from the cooling circuit or the reheat circuit to the recovery circuit.

10. The HVAC system of claim 1, wherein the controller is configured to restore application of the voltage to the compressor subsequent to interrupting the voltage based on execution of a time delay.

11. The HVAC system of claim 10, wherein the controller is configured to execute the time delay based on the signal sent to the multi-directional valve to adjust from the first position to the second position.

12. A control system for a heating, ventilation, and/or air conditioning (HVAC) system, wherein the control system comprises:

a multi-directional valve configured to receive refrigerant from a compressor of the HVAC system and configured to actuate to direct refrigerant through a cooling circuit of the HVAC system in a cooling operating mode and through a reheat circuit of the HVAC system in a reheat operating mode; and a controller configured to:

send a signal to actuate the multi-directional valve to switch from the cooling operating mode to the reheat operating mode;

interrupt a voltage provided to the compressor based on the signal;

execute a time delay based on the signal; and restore application of the voltage to the compressor after execution of the time delay.

13. The control system of claim 12, wherein the multi-directional valve is configured to between from the cooling operating mode to the reheat operating mode prior to expiration of the time delay.

14. The control system of claim 12, wherein the controller is configured to send the signal based upon a determination that a humidity measurement of a conditioned space serviced by the HVAC system exceeds a humidity set point.

15. The control system of claim 12, wherein the time delay is between one minute and three minutes.

16. The control system of claim 12, wherein the voltage is a first voltage, and the controller is configured to interrupt or provide a second voltage to a recovery valve to enable recovery of refrigerant from the cooling circuit or the reheat circuit.

17. The control system of claim 16, wherein the controller is configured to interrupt or provide the second voltage based on the signal.

18. A heating, ventilation, and/or air conditioning (HVAC) system, comprising:

a cooling circuit including a condenser, a compressor, an evaporator, and a multi-directional valve, wherein the HVAC system is configured to circulate refrigerant through the cooling circuit in a cooling operating mode;

a reheat circuit including a reheat heat exchanger, the compressor, the evaporator, and the multi-directional valve, wherein the HVAC system is configured to circulate refrigerant through the reheat circuit in a reheat operating mode; and a control system configured to make a determination to transition operation of the HVAC system from the cooling operating mode to the reheat operating mode, wherein the control system is configured to send a signal to the multi-directional valve to adjust from a first position to a second position based on the determination, interrupt a voltage provided to the compressor based on the determination and based on sending the signal to the multi-directional valve, execute a time delay based on the determination, and restore application of the voltage to the compressor at a conclusion of the time delay.

19. The HVAC system of claim 18, wherein the control system is configured to execute the time delay based on interruption of the voltage provided to the compressor.

20. The HVAC system of claim 18, wherein the control system is configured to execute the time delay based on the signal.

21. The HVAC system of claim 18, comprising a time delay relay configured to execute the time delay.

22. The HVAC system of claim 18, wherein the control system is configured to make the determination based on an indication that a humidity measurement of a conditioned space serviced by the HVAC system is above a humidity set point, and wherein the determination includes a determination to transition from the cooling operating mode to the reheat operating mode.

* * * * *